United States Patent [19]

Anderson

[11] 4,265,637

[45] May 5, 1981

[54] PROCESS FOR PREPARING BLENDING FUEL

[75] Inventor: Ardis L. Anderson, Ponca City, Okla.

[73] Assignee: Conoco, Inc., Ponca City, Okla.

[21] Appl. No.: 112,590

[22] Filed: Jan. 16, 1980

[51] Int. Cl.[3] ..... C10L 9/10; C10L 1/10

[52] U.S. Cl. ..... 44/51; 44/1 G; 44/6

[58] Field of Search ..... 44/1 R, 1 G, 6, 51

[56] References Cited

U.S. PATENT DOCUMENTS

| | | | |
|---|---|---|---|
| 219,181 | 9/1879 | Smith et al. | 44/51 |
| 1,647,471 | 11/1927 | Plausen et al. | 44/51 |
| 3,241,505 | 3/1966 | Long et al. | 44/51 |
| 3,985,516 | 10/1976 | Johnson et al. | 44/1 R |

*Primary Examiner*—Winston A. Douglas
*Assistant Examiner*—J. V. Howard
*Attorney, Agent, or Firm*—Richard W. Collins

[57] ABSTRACT

A process for preparing a blended fuel from lignite and fuel oil type hydrocarbons. The process involves drying lignite to a low moisture level, applying a treating liquid to the dried lignite, storing the treated lignite, and subsequently blending treated lignite with liquid hydrocarbon such as fuel oil.

2 Claims, No Drawings

PROCESS FOR PREPARING BLENDING FUEL

BACKGROUND OF THE INVENTION

The present invention relates to preparation of a fuel blend for use in furnace-boiler units. More particularly, the invention relates to preparation of a fuel blend comprised of treated lignite and heavy hydrocarbon oil.

The use of a blend of solid carbonaceous material and liquid hydrocarbons as a fuel for furnace-boiler units, gas manufacture, metallurgical operations and other purposes is known in the art. U.S. Pat. No. 219,181 describes such a fuel blend. However, difficulties have been encountered in the use of such fuel blends due to separation of the solid fuel from the liquid.

An attempt to overcome the separation problem is described in U.S. Pat. No. 1,431,225, which suggests addition of an emulsifying agent to avoid settling of the powdered solid carbonaceous material.

U.S. Pat. No. 3,764,547 discloses a fuel slurry comprised of solid carbonaceous material in liquid hydrocarbon with addition of soot. Various improvements in solid-liquid fuel slurries are also described in U.S. Pat. Nos. 4,082,516; 4,090,853; 4,101,293; and 4,147,519.

A process for producing a low-sulpur fuel by heating low-grade coal followed by pulverizing it and blending it with oil is described in U.S. Pat. No. 3,932,145.

A process for upgrading lignite to increase its heating value is described in U.S. Pat. No. 4,052,168.

Thus, it can be seen that a great deal of work has been done in an effort to utilize solid carbonaceous material as a component in a furnace fuel. Two primary problems are encountered in trying to utilize lignite as a component in a blended fuel. When particulate lignite is added to liquid, it is generally necessary to use a stabilizing agent of some sort to prevent separation and settling of the solid particles. If a stabilizing agent is not used, physical stirring is required. This problem could be avoided by blending the solid material just prior to introducing it to a burner. However, this would require storage of the solid material for a significant period of time, and dried lignite is very suscepticle to spontaneous ignition, such that it is not practical to dry lignite and store it for extended periods of time prior to blending it with a liquid fuel.

The foregoing problems are overcome by the present invention.

SUMMARY OF THE INVENTION

According to the present invention, lignitic type coal is first subjected to a drying step to substantially reduce the inherent moisture content, and the dried coal is then treated with a treating liquid to reduce the propensity of dried lignite to spontaneously ignite. The dried and treated lignite is stored, and as needed, is removed from storage, pulverized to a suitably small particle size, and blended with a liquid hydrocarbon fuel to provide a pumpable slurry for use in a furnace-boiler unit.

DESCRIPTION OF THE PREFERRED EMBODIMENT

As used herein, the term lignite refers to a low grade coal of the type classified by the American Society for Testing Materials as lignitic. Lignitic coal by definition has a moist heating value of less than 4,611 calories per gram. Lignitic coal (lignite) typically contains from 25 to 40 percent natural bed moisture not including visible water on the surface of the material. Because of this high moisture content, the heating value of lignite in its natural state is very low, generally less than 4,000 calories per gram.

It is known that the heating value of lignite can be significantly upgraded by removing moisture. However, lignite which has been dried tends to disintegrate, and more importantly, is very subject to spontaneous combustion. Because of the propensity for spontaneous combustion, it is generally not practical to store large amounts of dried lignite. On the other hand, it is not desirable to blend dried lignite with liquid hydrocarbon fuel in large volumes because of the need for expensive stabilizing agents to prevent settling of the lignite.

According to the present invention, lignite can be utilized in a blended fuel without the difficulties referred to above.

The first step in the process of this invention involves drying lignite to a moisture content of less than 20 percent by weight, and preferably to a range of 10 to 15 percent. The lignite should have a maximum particle diameter of about 5 centimeters prior to the drying step, and preferably should have a particle size of about 1 to $1\frac{1}{2}$ centimeters.

The dried lignite is then treated with a liquid hydrocarbon treating material to reduce dusting of the lignite and to reduce or eliminate its tendency to spontaneously ignite. The treating material can be any hydrocarbon liquid having a minimum flash point of 65° C. Suitable materials are No. 6 fuel oil, residual oil, heavy distillates and other low value refinery streams. Preferably, the treating liquids have a flash point above 90° C. A preferred treating material is a blend of from 50 to 75 volume percent decant oil from a fluidized bed catalytic cracking operation, the decant oil having a K factor of not more than 10.5, and from 50 to 25 volume percent asphalt. The K factor is a well-known characterization index indicating the degree of aromaticity of hydrocarbon oil and it is obtained by dividing the cube root of the average boiling point of the oil in degrees Rankine by the specific gravity of the oil at 60° F. (15.6° C.). A treating liquid having these characteristics is described in detail in Application Ser. No. 953,392 entitled "Coal Spray Composition" and assigned to the assignee of this application, now U.S. Pat. No. 4,201,657.

The treating liquid should be applied uniformly, generally by spraying, at the rate of from 2 to 20 liters of treating material per metric ton (1,000 kg) of lignite. Preferably, about 8 liters of treating material per metric ton of lignite are used. Dried lignite treated in this manner has a much lower tendency to spontaneously ignite, and can be stored in large volume for extended periods of time without problems. It also has improved handling characteristics in subfreezing weather and has lower dust losses. The treated lignite may be stored for an extended period of time, such as several weeks or months, without the problems normally associated with storage of dried lignite. Substantial benefits are obtained when the storage period is three days or more.

The dried and treated lignite, if not already of a size suitable for blending with liquid hydrocarbon fuel for forming a pumpable fuel blend, is then pulverized to a size no greater than 20 mesh (U.S. Standard Sieve Series). Smaller particles may be required, depending upon burner design and other factors. In some cases, very finely divided material such as less than 200 mesh will be preferred.

The final blend of solid and liquid fuel is prepared by removing the treated lignite from storage, grinding it if necessary, and adding it to a liquid hydrocarbonaceous fuel such as No. 6 fuel oil, petroleum residual oil, coal-derived oil or the like. Any liquid fuel which is suitable for firing a furnace-boiler unit may be used as the liquid component of the fuel blend.

The amount of solid material added to the liquid fuel may be from 1 to 50 percent by weight, and in some cases, possibly even higher. The only limitation on the amount of solid being that the blend be a pumpable mixture which will flow to the particular burners being used and operate satisfactorily therein.

By treating dried lignite with a treating material, and particularly with the preferred treating material described herein, a solid fuel component which can be stored for long periods of time is provided. By blending the treated lignite with a liquid fuel just prior to using the blend to fuel a furnace, the necessity to include stabilizing agents is eliminated. In addition to the benefits previously mentioned, lignite is typically a low sulphur material, and the ability to use lignite in a fuel provides an overall reduction in sulphur emissions. More importantly, it enables the use of abundant lignite resources to extend the supply of scarce liquid hydrocarbons.

We claim:

1. A process of preparing a blended fuel comprising:

(a) subjecting lignite containing its natural bed moisture to a drying step in which the moisture content of the lignite is reduced to from 10 to 20 percent by weight water;

(b) applying a hydrocarbon liquid having a flash point of greater than 65° C. to the dried lignite in an amount of from 2 to 20 liters of liquid per metric ton of dried lignite, wherein said hydrocarbon liquid is comprised of 50 to 75 volume percent decant oil from a fluidized bed catalytic cracking operation having a K factor of not more than 10.5 and 50 to 25 volume percent asphalt;

(c) storing the liquid treated lignite from step (b); and (d) removing stored lignite and blending it with sufficient hydrocarbon fuel oil to provide a pumpable mixture.

2. The process of claim 1 wherein the lignite is dried to between 10 and 15 percent by weight water.

* * * * *